United States Patent [19]

Furuhashi et al.

[11] 4,449,504

[45] May 22, 1984

[54] DISTRIBUTOR TYPE FUEL INJECTION PUMP

[75] Inventors: Yasuhiro Furuhashi; Yukinori Miyata, both of Kariya; Osamu Hishinuma, Susono, all of Japan

[73] Assignee: Nippondenso Co., Ltd., Kariya, Japan

[21] Appl. No.: 480,129

[22] Filed: Mar. 29, 1983

[30] Foreign Application Priority Data

Mar. 31, 1982 [JP] Japan ..... 57/46277[U]

[51] Int. Cl.[3] ..... F02M 59/20

[52] U.S. Cl. ..... 123/447; 123/449; 123/382; 123/503; 417/289

[58] Field of Search ..... 123/447, 449, 382, 385–388, 123/503; 417/282, 289, 294

[56] References Cited

U.S. PATENT DOCUMENTS 3,058,455 10/1962 Hofer et al. ..... 123/387

FOREIGN PATENT DOCUMENTS 1576617 8/1973 Fed. Rep. of Germany ..... 123/447
1807554 2/1979 Fed. Rep. of Germany ..... 123/447
56-105656 8/1981 Japan .
56-154158 11/1981 Japan .
97025 6/1982 Japan ..... 123/449

*Primary Examiner*—Ira S. Lazarus
*Assistant Examiner*—Magdalen Moy
*Attorney, Agent, or Firm*—Cushman, Darby & Cushman

[57] ABSTRACT

A distributor type fuel injection pump has an accumulator. When an internal combustion engine is in low-speed rotation or in low-load operation, the accumulator accumulates part of the fuel pressurized within a fuel compression chamber, thereby lowering the fuel injection rate. Also, the fuel injection pump is provided with compensator which operates simultaneously with the accumulator. While the injection rate is lowered by operation of the accumulator, the compensator extends the injection period to compensate for the reduction of injection quantity attributed to reduction of the injection rate.

9 Claims, 3 Drawing Figures

DISTRIBUTOR TYPE FUEL INJECTION PUMP

BACKGROUND OF THE INVENTION

This invention relates to a distributor type fuel injection pump used in an internal combustion engine, and more specifically, to a distributor type fuel injection pump adapted to attenuate noise attributed to combustion sound produced in an internal combustion engine when the engine is in low-speed rotation or in low-load operation.

When in low-speed rotation or in low-load operation, e.g., when idling, a diesel engine, for example, suffers higher noise attributed to combustion sound than does a gasoline engine. As a measure to counter the noise of the diesel engine, a method is conventionally known in which the injection rate (injection quantity per unit time) of fuel injected into the combustion chambers of the engine is lowered when the engine is in low-speed rotation or in low-load operation. This method is applied to distributor type fuel injection pumps stated in Japanese Utility Model Disclosure No. 105656/81 and Japanese Patent Disclosure No. 154158/81.

In the fuel injection pump stated in Japanese Utility Model Disclosure No. 105656/81, however, the amount of fuel injected is reduced too much to keep proper operation of the engine in low-speed rotation or in low-load operation, so that the fuel injection quantity is substantially reduced.

In the fuel injection pump stated in Japanese Patent Disclosure No. 154158/81, on the other hand, the amount of fuel to be injected varies solely depending upon the variation of the inner diameter of the return or accumulation passage, and moreover the time of fuel injection is retarded, since it takes no measure to control pressure at the entrance to the return or accumulation passage. Thus, the injection rate cannot be controlled with a high degree of accuracy.

SUMMARY OF THE INVENTION

The object of this invention is to provide a distributor type fuel injection pump capable of controlling the fuel accumulation quantity with a high degree of accuracy, to lower the injection rate when an engine is in low-speed rotation or in low-load operation; and, which is capable of increasing the injection quantity of fuel actually injected into the combustion chambers of the engine by an amount corresponding to the accumulation quantity.

According to this invention, a distributor type fuel injection pump is provided to inject high-pressure fuel into each combustion chamber of an internal combustion engine, which comprises: a pump housing defining a low-pressure fuel supply chamber therein; a distribution head coupled to the pump housing and having as many discharge ports as it has cylinders in the internal combustion engine; a pump cylinder housed in the distribution head and defining a fuel compression chamber therein, a plunger fitted into the pump cylinder so as to be able to reciprocate and rotate in synchronism with operation of the internal combustion engine and having a distribution groove thereon which is selectively connected to each of the discharge ports and communicates with the fuel compression chamber, whereby the fuel is sucked from the fuel supply chamber into the fuel compression chamber to be pressurized therein for each stroke of the plunger and the high-pressure fuel is injected from a specified discharge port into the combustion chamber of the internal combustion engine as the distribution groove is connected to the specified discharge port in accordance with the rotation position of the plunger; injection quantity adjusting means opening with a given timing a passage connecting the fuel compression chamber and the fuel supply chamber, thereby adjusting the injection quantity of the fuel delivered under pressure from the fuel compression chamber, in accordance with the operating condition of the internal combustion engine; an accumulator fixed to the distribution head and having therein a communication chamber connected to the fuel supply chamber, the accumulator including cylinder means having a piston and defining therein an accumulation chamber capable of being connected to the fuel compression chamber, and a spring housed in the communication chamber and urging the piston, with a fixed force, in the direction to reduce the capacity of the accumulation chamber; a valve disposed in a passage connecting the fuel compression chamber, the accumulator and the fuel supply chamber, so that the accumulator is prevented from operating when the valve is closed; and compensating means opening the valve in at least one of the states in which the internal combustion engine is in low-speed rotation and in which said engine is in low-load operation and compensating the operation of the injection quantity adjusting means so that the fuel injection quantity is increased to a predetermined degree.

DETAILED DESCRIPTION OF THE PREFERRED EMBODIMENTS

Figure 1:
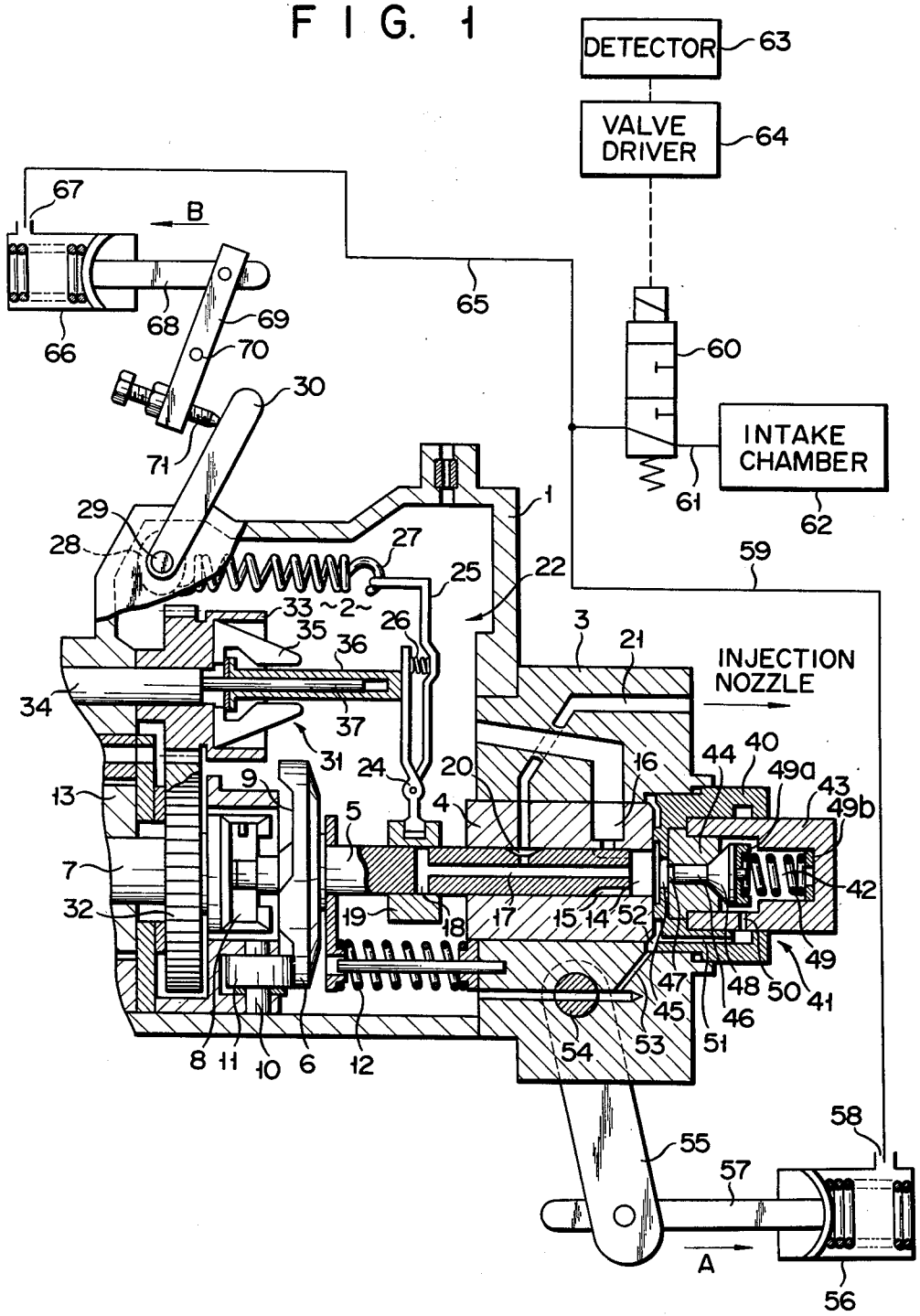
FIG. 1 is a sectional view, partially including a pneumatic circuit diagram, of a distributor type fuel injection pump according to a first embodiment of this invention.

Referring now to FIG. 1, a distributor type fuel injection pump is shown according to a first embodiment of this invention.

In FIG. 1, the fuel injection pump has a housing 1, in which is defined a fuel supply chamber 2. A distribution head 3 is fixed to the housing 1. A pump cylinder 4 is fitted into the distribution head 3 in an oiltight manner. A plunger 5 is slidably and rotatably inserted into the pump cylinder 4. The plunger 5 extends into the fuel supply chamber 2 and a concentric face cam 6 is fixed to the extended end of the plunger 5. The face cam 6 is coaxially connected by means of a coupling 8 to a drive shaft 7 which is rotated synchronously with the drive of a diesel engine (not shown). The coupling 8 has the function of continuously transmitting the rotation of the drive shaft 7 to face cam 6 and allowing the axial movement of face cam 6, relative to the drive shaft 7.

A roller 11, which is rotatably supported in the housing 1 by a support shaft 10, is in rolling contact with a cam surface 9 of the face cam 6. When rotated synchronously with the rotation of the drive shaft 7, therefore, the face cam 6 is axially reciprocated at a given stroke through the contact between its cam surface 9 and the roller 11. Thus, the plunger 5 can reciprocate at a predetermined stroke inside the pump cylinder 4, while rotating on its own axis. Actually, the plunger 5 is returned by the restoring force of a return spring 12.

The drive shaft 7 drives a feed pump 13, whereby the fuel supply chamber 2 is filled with fuel. As is conventionally known, the fuel pressure inside the fuel supply chamber 2 is controlled in accordance with the engine speed by a pressure control valve (not shown). As the engine speed increases, therefore, the fuel pressure increases.

In the pump cylinder 4, the space between the plunger 5 and a cap 40, as mentioned later, is defined as a fuel compression chamber 14. A plurality of intake grooves 15 are formed on the outer peripheral surface of the head portion of the plunger 5. The intake groove 15 extend in the axial direction of the plunger 5, at intervals along the circumference of the plunger 5, and open into the fuel compression chamber 14. There are as many intake grooves 15 as engine cylinders. An intake passage 16 is formed in the distribution head 3. One end of the intake passage 16 opens into the fuel supply chamber 2, while the other end extends into the cylinder 4, opening to the inner surface of the cylinder 4, so as to be able to communicate with the intake grooves 15. Thus, when the plunger 5, in reciprocation, is moved to the left of FIG. 1, i.e., in a fuel intake stroke, one of the intake grooves 15 and the intake passage 16 communicate with each other as the plunger 5 rotates. As a result, the fuel in the fuel supply chamber 2 is fed into the fuel compression chamber 14 through the intake passage 16 and the connected intake groove 15.

Axially formed in the plunger 5 is an internal passage 17 which opens to the head face of the plunger 5 to be communicated with the fuel compression chamber 14. The internal passage 17 extends to that portion of the plunger 5 which is located inside the fuel supply chamber 2, and is connected to the fuel supply chamber 2 by means of a radial spill port 18 radially extending inside the plunger 5. Specifically, the fuel compression chamber 14 communicates with the fuel supply chamber 2 by means of the internal passage 17 and the spill port 18 inside the plunger 5. However, the openings of the spill port 18 opening into the fuel supply chamber 2 are openably closed by a spill ring 19, as will be mentioned later.

A distribution groove 20 communicating with the internal passage 17 is formed on the outer peripheral surface of the plunger 5. As many delivery passages 21 as engine cylinders are formed in the distribution head 3. FIG. 1 shows only one of the delivery passages 21. As described in further detail later, the delivery passages 21 are always kept disconnected from the intake passage 16. One end of each delivery passage 21 extends into the cylinder 4 and opens to the inner surface of the cylinder 4. Thus, the openings of the delivery passages 21 are arranged at regular intervals along the circumferential direction of the cylinder 4, so as to be able to communicate with the distribution grooves 20. As shown in FIG. 1, the other end of each delivery passage 21 is connected to the injection nozzle of its corresponding engine cylinder by means of a delivery valve (not shown).

At the end of the fuel intake stroke, the intake grooves 15 are disconnected from the intake passage 16 as the plunger 5 rotates. Thus, the intake stroke is ended. Thereafter, when the plunger 5 is moved to the right of FIG. 1 with the intake grooves 15 and the intake passage 16 kept disconnected, a compression stroke for pressurizing the fuel in the fuel compression chamber 14 starts. At the beginning of the compression stroke, the distribution groove 20 communicates with none of the delivery passages 21. At this moment, moreover, the spill port 18 is closed by the spill ring 19. Thereafter, when the fuel in the fuel compression chamber 14 is pressurized to a predetermined pressure level as the plunger 5 moves to the right, the distribution groove 20 is connected to one of the delivery passages 21 as the plunger 5 rotates. Thus, the pressurized fuel in the fuel compression chamber 14 is supplied to one of the injection nozzles of the engine cylinders through the connected delivery passage 21 and the delivery valve. Thereafter, when the plunger 5 moves to the right to reach a predetermined position, the openings of the spill port 18 having so far been closed by the spill ring 19 are opened, i.e., exposed to the fuel supply chamber 2. At this point in time, the fuel compression chamber 14 in the compression stroke is connected to the fuel supply chamber 2 by the internal passage 17 and the spill port 18, so that the fuel in the fuel compression chamber 14 will not be pressurized any more. Thus, the moment the spill port 18 is opened, the fuel supply to the injection nozzle is stopped, so that the fuel injection quantity is determined.

After the intake and compression of fuel are executed once by the rotation and reciprocation of the plunger 5, the distribution groove 20 is connected to one of the delivery passages 21 and a predetermined amount of pressurized fuel is supplied to the injection nozzle through the connected delivery passage 21. More specifically, if the engine is, for example, a four-cylindered engine, the plunger 5 is reciprocated once while it makes a quarter revolution. The pressurized fuel is supplied to each injection nozzle with a given timing for each reciprocation.

As for the spill ring 19, it is provided for adjusting the fuel injection quantity in accordance with the engine speed. The spill ring 19 is fitted on the outer peripheral surface of the plunger 5 in an oiltight manner, and can move along the axis of the plunger 5. The movement of the spill ring 19 is controlled by an injection quantity adjusting means 22. As shown in FIG. 1, the injection quantity adjusting means 22 includes a supporting lever 23 which is coupled at its lower end to the spill ring 19. The supporting lever 23 is rotatably fixed at an intermediate portion thereof on a shaft 24. Also, the lower end of a tension lever 25 is fixed to the shaft 24. The middle portion of the tension lever 25 and the upper end portion of the supporting lever 23 are coupled by means of an idle spring 26. The two levers 23, 25 can be rocked independently of each other. The upper end of the tension lever 25 is coupled to a circular rotating plate 28 by means of a main spring 27. In this case, one end of the main spring 27 is coupled to the rotating plate 28. The rotating shaft 29 projects from the housing 1 in an oiltight manner. An adjusting lever 30 is fixed to the projected end of the rotating shaft 29.

A centrifugal governor 31 faces the supporting lever 23. The centrifugal governor 31 includes a carrier 33 in mesh with a gear 32 which is fixed on the drive shaft 7. The carrier 33 is rotated on a rotating shaft 34 in synchronism with the engine. The carrier 33 includes a governor sleeve 36 interlocked with flyweights 35. The governor sleeve 36 is fitted on a guide shaft 37 coaxial with the rotating shaft 34, and can slide along the axis of the guide shaft 37. The governor sleeve 36 extends toward the supporting lever 23, having its extreme end abutting against the upper end portion of the supporting lever 23. Thus, the centrifugal governor 31 applies its centrifugal force to the flyweights 35 as the carrier 33 is rotated synchronously with the engine. As the centrifugal force based on the engine speed increases, the flyweights 35 are rocked to spread out. The rocking of the flyweights 35 causes the governor sleeve 36 to be pushed out to the right of FIG. 1, to press the supporting lever 23 against the urging force of the idle spring 26. As a result, the supporting lever 23 is rocked clockwise around the shaft 24, to move the spill ring 19 to the left of FIG. 1. In this case, the spill port 18 is opened at earlier timing, so that the fuel injection quantity is decreased. On the other hand, when the engine speed is lowered to reduce the centrifugal force acting on the flyweights 35, the supporting lever 23 is rocked counterclockwise by the urging force of the idle spring 26, thereby moving the spill ring 19 to the right. As a result, the fuel injection quantity is increased. Thus, the centrifugal governor 31 serves to increase or decrease the injection quantity in accordance with the engine speed.

A cap 40 is fixed in an oiltight manner to that portion of the distribution head 3 which is on the right of the fuel compression chamber 14. An accumulator 41 is fitted into the cap 40, coaxially with the pump cylinder 4. The accumulator 41 has a housing 43 defining a spring chamber 42 therein. One end portion of the housing 43 is fitted into the cap 40 in an oiltight manner. A cylinder 44 is oiltightly fitted into the end of the housing 43 in the vicinity of the fuel compression chamber 14. One end of the cylinder 44 communicates with the fuel compression chamber 14 by means of a communicating bore 45 in the cap 40, while the other end communicates with the spring chamber 42. The cylinder 44 is disposed on the same axis as the pump cylinder 4.

A piston 46 defining an accumulation chamber 47 therein is slidably fitted into the cylinder 44 in an oiltight manner. Thus, the fuel compression chamber 14 and the accumulation chamber 47 communicate with each other.

The piston 46 has a thick portion 48 extending into the spring chamber 42. A spring 49 is housed in the spring chamber 42 to continuously urge the thick portion 48 of the piston 46 to the left of FIG. 1 at a fixed rate of pressure. Thus, the thick portion 48 normally abuts against the cylinder 44. In FIG. 1, numerals 49*a* and 49*b* designate the spring seats of spring 49.

Formed in the housing 43 of the accumulator 41 is a bore 50, one end of which opens into the spring chamber 42. The other end of the bore 50 communicates with one end of a bore 51 formed in the cap 40. The other end of the bore 51 opens into a space 52 which is defined between the cylinder 44 and the cap 40 so as to be isolated from the fuel compression chamber 14 in an oiltight manner. Formed in the distribution head 3 is a bore 53, one end of which opens into the space 52 and the other end of which opens into the fuel supply chamber 2. Thus, the spring chamber 42 and the fuel supply chamber 2 communicate with each other by means of bores 50 and 51, space 52 and bore 53, so that the spring chamber 42 is filled with the fuel led from the fuel supply chamber 2.

A rotary valve 54 is disposed in the middle of one of the bores connecting the spring chamber 42 and the fuel supply chamber 2, e.g., bore 53, whereby the bore 53 is opened and closed. The rotary valve 54 is normally closed.

The operation of the rotary valve 54 and the rocking of the adjusting lever 30 are controlled by a compensating means, as mentioned below. One end of a valve lever 55 is fixed to a valve shaft (not shown) of the rotary valve 54. The other end of the valve lever 55 is coupled to an output rod 57 of a first pneumatic actuator 56. A port 58 of the first pneumatic actuator 56 is coupled to a solenoid operated valve 60 by means of a pneumatic passage 59. The solenoid operated valve 60 is connected to a negative pressure source, e.g., an intake chamber 62 of the engine, by means of a pneumatic passage 61. In the state shown in FIG. 1, the solenoid operated valve 60 is in its opened position, and the intake chamber 62 and the pneumatic passage 59 communicate with each other. The solenoid operated valve 60 is operated by a detector 63 for detecting the engine load or engine speed and a valve driver 64 for producing an actuating signal to the solenoid operated valve 60 in response to a signal from the detector 63. In this case, when the engine load or speed exceeds a predetermined value, the solenoid operated valve 60 is closed in response to a signal from the valve driver 64.

A branch pneumatic passage 65 diverges from the middle portion of the pneumatic passage 59, and is connected to a port 67 of a second pneumatic actuator 66.

An output rod 68 of the second pneumatic actuator 66 is coupled to one end of a link lever 69. The link lever 69 is rockably mounted at the middle portion thereof on a pin 70. An adjusting bolt 71 is movably screwed in the other end of the link lever 69. The screw end of the adjusting bolt 71 abuts against the adjusting lever 30. Thus, when the adjusting bolt 71 is turned or moved to rock the adjusting lever 30, the tension lever 25 is rocked around the shaft 24 through the medium of the main spring 27. As a result, the position of the spill ring 19 is adjusted. Thus, initial positioning of the spill ring 19 can be achieved by means of the adjusting bolt 71.

The operation of the fuel injection pump according to the first embodiment of the construction mentioned above may now be described.

While the engine is in normal- or high-speed rotation or in normal- or high-load operation, the solenoid operated valve 60 and the rotary valve 54 are both closed. In this state, the plunger 5 is rotated and reciprocated by the engine to supply a predetermined amount of pressurized fuel from the fuel compression chamber 14 to each injection nozzle at a given timing, as mentioned above. In this case, the injection quantity of the fuel delivered under pressure from the fuel compression chamber 14 is adjusted in accordance with the engine speed, by the operation of the centrifugal governor 31.

When the engine is idling under conditions wherein the engine load or speed is lower than the value set in the detector 63, the solenoid operated valve 60 receives the signal from the valve driver 64 to be actuated and opened thereby. Accordingly, the intake chamber 62 is connected to pneumatic actuators 56 and 66 by means of the pneumatic passages 59, 61 and 65, so that pneumatic actuators 56 and 66 are operated simultaneously by the negative pressure in the intake chamber 62. As regards the first pneumatic actuator 56, its rod 57 is moved in the direction of arrow A in FIG. 1. As the rod 57 moves in this manner, the valve lever 55 is rocked counterclockwise. As a result, the rotary valve 54 is opened as shown in FIG. 1. Thus, the bore 53 is opened by the rotary valve 54, so that the spring chamber 42 and the fuel supply chamber 2 communicate with each other. In this state, when the fuel compression stroke is started by movement of the plunger 5 to the right, the piston 46 of the accumulator 41 receives at its left end face the internal pressure of the fuel compression chamber 14 and is moved to the right against the urging force of the spring 49. Thus, part of the fuel in the spring chamber 42 corresponding to the displacement of the piston 46 is led into the fuel supply chamber 2 through bores 50 and 51, space 52 and bore 53. When the plunger 5 moves to the left to start the intake stroke after the compression stroke is ended, the piston 46 is pushed to the left by the restoring force of the spring 49 and is moved until its thick portion 48 abuts against the cylinder 44. In the compression stroke, therefore, the capacity of the accumulation chamber 47 communicating with the fuel compression chamber 14 substantially increases as the piston 46 moves to the right. Accordingly, the pressure of the fuel pressurized in the fuel compression chamber 14 is lowered for the increment of the capacity. As a result, the fuel injection speed and, hence, the injection rate are lowered.

As regards the second pneumatic actuator 66, on the other hand, its rod 68 is moved in the direction of arrow B by the negative pressure in the intake chamber 62. As the rod 68 moves in this manner, the link lever 69 is rocked counterclockwise around the pin 70 to cause the adjusting bolt 71 to press the adjusting lever 30. Thus, the adjusting lever 30 is rocked clockwise. As the adjusting lever 30 rocks in this manner, the tension lever 25 is rocked to the left of FIG. 1 through the medium of the main spring 27. As a result, the spill ring 19 is moved to the right, so that the spill port 18 is opened with a time lag, and the fuel injection quantity is increased. The increment of the injection quantity agrees with the shortage of the injection quantity attributed to the reduction of the injection rate.

Thereafter, when the engine proceeds to the normal- or high-speed rotation or the normal- or high-load operation, the solenoid operated valve 60 is closed and the respective rods 57, 68 of the pneumatic actuators 56, 66 are returned to their original positions. Thus, the rotary valve 54 is closed and the piston 46 of the accumulator 41 is rendered inoperational. As the adjusting lever 30 and the tension lever 25 are returned, the spill ring 19 is also returned to its original position. Thereafter, the movement of the spill ring 19 is controlled by the centrifugal governor 31.

According to the first embodiment of the invention, as described above, when the engine is in low-speed rotation or in low-load operation, noise produced at combustion can be attenuated by lowering the fuel injection rate. The shortage of the injection quantity attributed to reduction of the injection rate can be compensated for by substantially extending the injection period.

Since the piston 46 of the accumulator 41 is accurately reciprocated by the urging force of the spring 49, the fuel accumulation quantity is fixed and the injection rate can be controlled with a high degree of accuracy.

Figure 2:
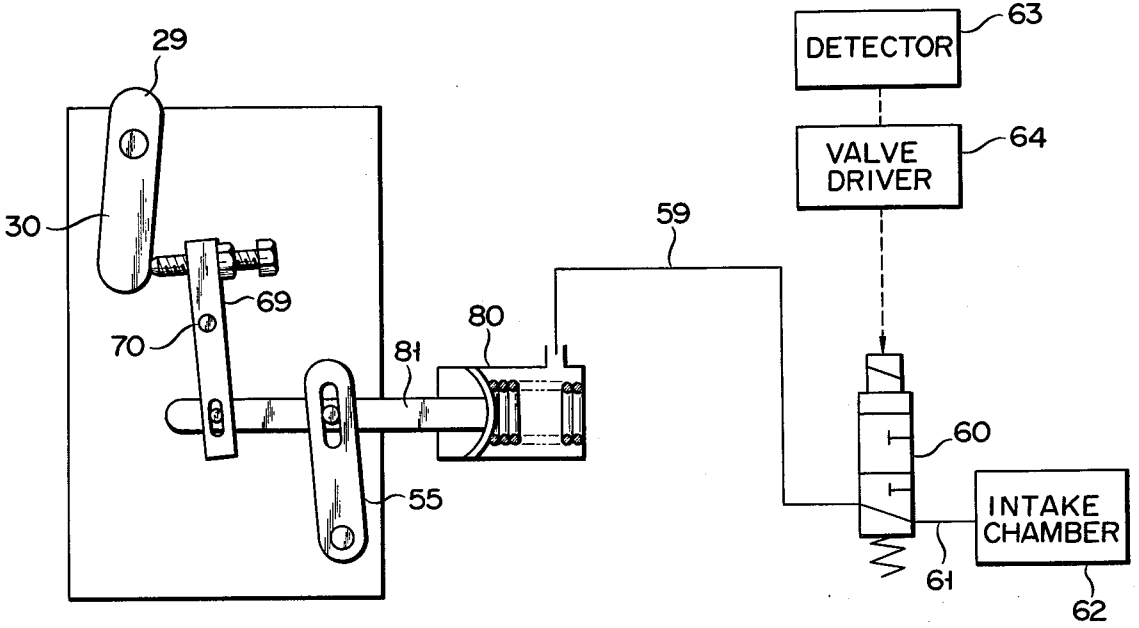
FIG. 2 is a schematic view, partially including a pneumatic circuit diagram, of a distributor type fuel injection pump according to a second embodiment of the invention.

This invention is not limited to the first embodiment described above. FIG. 2 shows a second embodiment of the invention, in which only a single pneumatic actuator 80 is used. As shown in FIG. 2, the actuator 80 is connected to a solenoid operated valve 60 by means of a pneumatic passage 59. A valve lever 55 and an adjusting lever 30 are connected individually to a rod 81 of the actuator 80. It is to be understood that the fuel injection pump according to this second embodiment, constructed in this manner, has the same function as that of the first embodiment. In FIG. 2, like reference numerals are used to designate those members which have the same functions as their counterpart members in the first embodiment.

Figure 3:
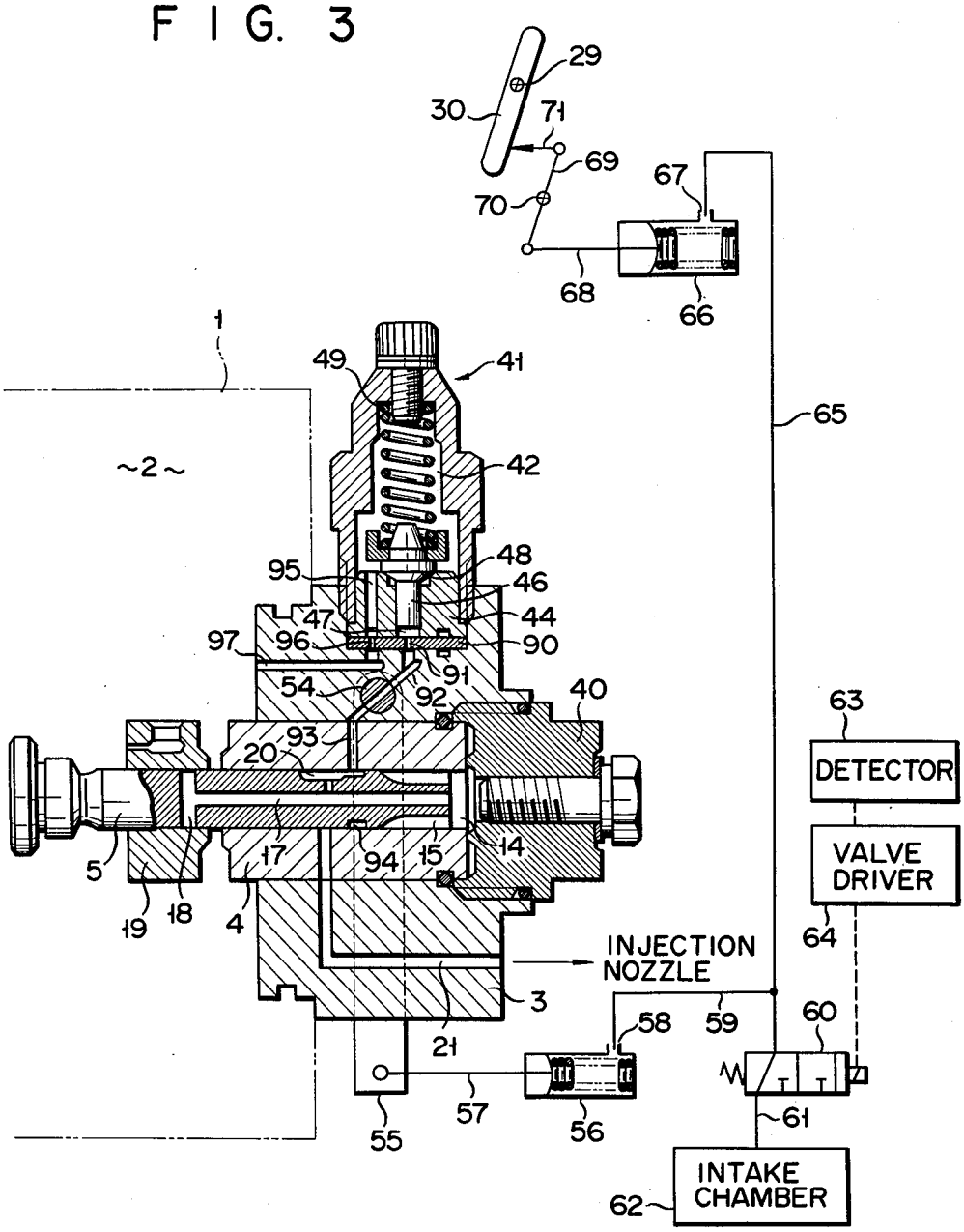
FIG. 3 is a sectional view, partially including a pneumatic circuit diagram, of a distributor type fuel injection pump according to a third embodiment of the invention.

FIG. 3 shows a third embodiment of the invention, in which like reference numerals refer to like members included in the first embodiment. In the description to follow, only the differences between the first and third embodiments will be pointed out. In the third embodiment, an accumulator 41 extends at right angles to a pump cylinder 4. Specifically, an accumulation chamber 47 of the accumulator 41 communicates with a bore 92 in a distribution head 3 by means of a bore 91 in a throttle plate 90. The bore 92 in the distribution head 3 is connected to a bore 93 formed in the pump cylinder 4 which, in turn, is connected to a ring-shaped groove 94 formed on the outer peripheral surface of the plunger 5. The ring-shaped groove 94 is continuous with a distribution groove 20. When in the compression stroke, the accumulation chamber 47 and the distribution groove 20 can communicate with each other by means of the bores 91, 92 and 93 and the ring-shaped groove 94. A rotary valve 54 is disposed in the middle of bore 93.

A spring chamber 42 of the accumulator 41 always communicates with a fuel supply chamber 2 by means of bores 95, 96 and 97, which are formed in a cylinder 44, the throttle plate 90 and the distribution head 3, respectively.

It is to be understood that the fuel injection pump according to the third embodiment of the aforementioned construction, in which part of the fuel delivered under pressure from a fuel compression chamber 14 is accumulated in the accumulation chamber 47, has the same function as that of the first embodiment.

Although the actuator used in the first to third embodiments has been described as being of a pneumatic type, this invention is not limited to those embodiments. For example, the actuator may be of a hydraulic type, so that the negative pressure source may be an oil pressure source.

In this invention, moreover, the actuator may be replaced with an electromagnetic solenoid.

Furthermore, in this invention, the link lever 69 may be so designed as to directly actuate the tension lever 25, the spill ring 19 or other injection quantity control member, instead of actuating the adjusting lever 30.

What we claim is:

1. A distributor type fuel injection pump for injecting high-pressure fuel into each combustion chamber of an internal combustion engine, comprising:

a pump housing defining a low-pressure fuel supply chamber therein;

a distribution head coupled to the pump housing and having as many discharge ports as cylinders in the internal combustion engine;

a pump cylinder housed in the distribution head and defining a fuel compression chamber therein;

a plunger fitted into the pump cylinder, so as to be able to reciprocate and rotate in synchronism with the operation of the internal combustion engine and having a distribution groove thereon, said distribution groove being selectively connected to each of the discharge ports and communicating with the fuel compression chamber, whereby the fuel is sucked from the fuel supply chamber into the fuel compression chamber, to be pressurized therein for each stroke of the plunger, and the high-pressure fuel is injected from a specified discharge port into the combustion chamber of the internal combustion engine as the distribution groove is connected to the specified discharge port in accordance with the rotation position of the plunger;

injection quantity adjusting means opening with a given timing a passage connecting the fuel compression chamber and the fuel supply chamber, thereby adjusting the injection quantity of the fuel delivered under pressure from the fuel compression chamber, in accordance with the operating condition of the internal combustion engine;

an accumulator fixed to the distribution head and having therein a communication chamber connected to the fuel supply chamber, said accumulator including:

cylinder means having a piston and defining therein an accumulation chamber capable of being connected to the fuel compression chamber, and a spring housed in the communication chamber and urging with a fixed force the piston in the direction to reduce the capacity of the accumulation chamber;

a valve disposed in a passage connecting the fuel compression chamber, the accumulator and the fuel supply chamber so that the accumulator is prevented from operating when the valve is closed; and compensating means for opening the valve in at least one of the states in which the internal combustion engine is in low-speed rotation and in which said engine is in low-load operation and for compensating the operation of the injection quantity adjusting means so that the fuel injection quantity is increased to a predetermined degree.

2. The distributor type fuel injection pump according to claim 1, wherein said valve is disposed in the middle of a passage connecting the communication chamber of the accumulator and the fuel supply chamber.

3. The distributor type fuel injection pump according to claim 2, wherein said accumulator is disposed on the same axis as the pump cylinder of the distribution head.

4. The distributor type fuel injection pump according to claim 1, wherein said compensating means includes two pneumatic actuators simultaneously operated by a negative pressure source and serving individually as a drive source for operating the valve and another drive source for compensating the operation of the compensating means.

5. The distributor type fuel injection pump according to claim 1, wherein said compensating means includes a pneumatic accumulator operated by a negative pressure source and serving both as a drive source for operating the valve and as another drive source for compensating the operation of the compensating means.

6. The distributor type fuel injection pump according to claim 4, wherein said negative pressure source is an intake chamber of the internal combustion engine.

7. The distributor type fuel injection pump according to claim 1, wherein said accumulator is so disposed as to cross the pump cylinder of the distribution head.

8. The distributor type fuel injection pump according to claim 7, wherein said valve is disposed in a passage connecting the accumulation chamber of the accumulator and the fuel compression chamber.

9. The distributor type fuel injection pump according to claim 8, wherein said passage connects the accumulation chamber and the distribution groove.

* * * * *